United States Patent [19]

Ragen

[11] 4,109,896

[45] Aug. 29, 1978

[54] BOAT HOISTS

[76] Inventor: Peter D. Ragen, 921 S. 102nd St., Milwaukee, Wis. 53214

[21] Appl. No.: 760,317

[22] Filed: Jan. 18, 1977

[51] Int. Cl.[2] ..... B63C 23/60

[52] U.S. Cl. ..... 254/144; 187/8.59; 187/20; 214/1 A

[58] Field of Search ..... 214/1 A, 1 R; 187/8.59, 187/8.71, 20, 11; 254/144, 148, 139, 139.1; 61/65

[56] References Cited

U.S. PATENT DOCUMENTS

| | | | |
|---|---|---|---|
| 2,846,275 | 8/1958 | Esch | 187/8.59 X |
| 3,077,742 | 2/1963 | Brown | 254/144 X |
| 3,291,260 | 12/1966 | Woor et al. | 187/8.59 X |
| 3,697,048 | 10/1972 | Sarno | 187/8.59 X |
| 4,010,826 | 3/1977 | Jones | 254/144 X |

FOREIGN PATENT DOCUMENTS

| | | | |
|---|---|---|---|
| 1,051,805 | 2/1952 | France | 187/8.59 |
| 1,098,117 | 1/1954 | France | 187/8.59 |
| 372,573 | 5/1932 | United Kingdom | 187/8.59 |

*Primary Examiner*—Frank E. Werner

*Attorney, Agent, or Firm*—Wheeler, Morsell, House & Fuller

[57] ABSTRACT

A boat hoist has longitudinally spaced lifting beams together with winch and cable means for raising and lowering the beams simultaneously by manipulation of a single hand wheel to move a boat straight up and down, there being a scissors support for each beam to insure smooth action and uniform movement throughout the length of each beam. The arrangement is such that the hoist may be employed to free the feet of the main frame from the lake bottom at the end of a season preparatory to removing the hoist from the water.

3 Claims, 4 Drawing Figures

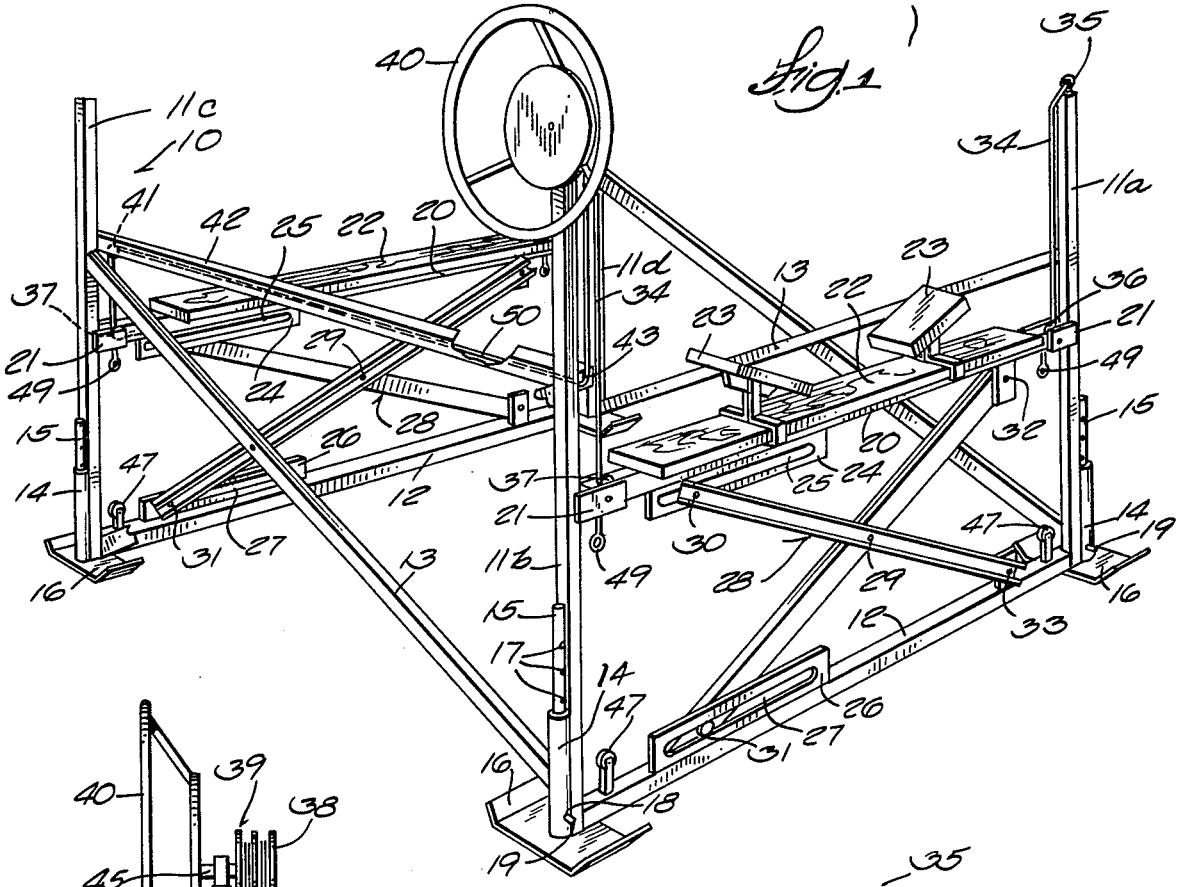
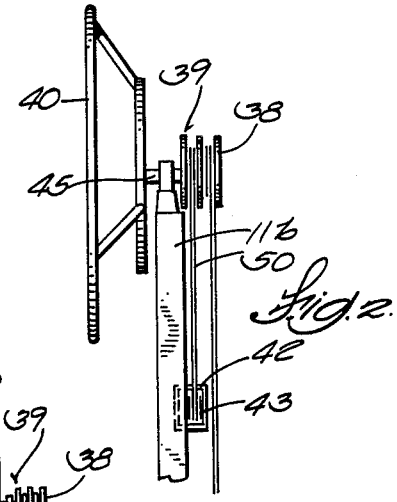
Fig. 2
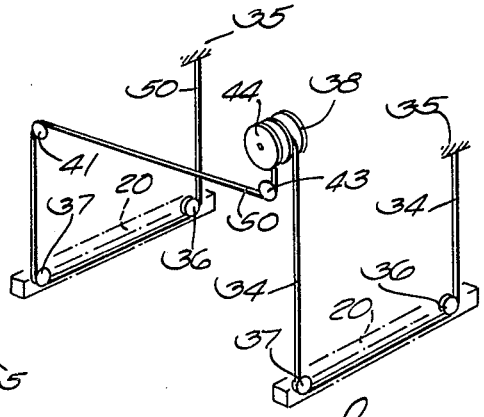
Fig. 3
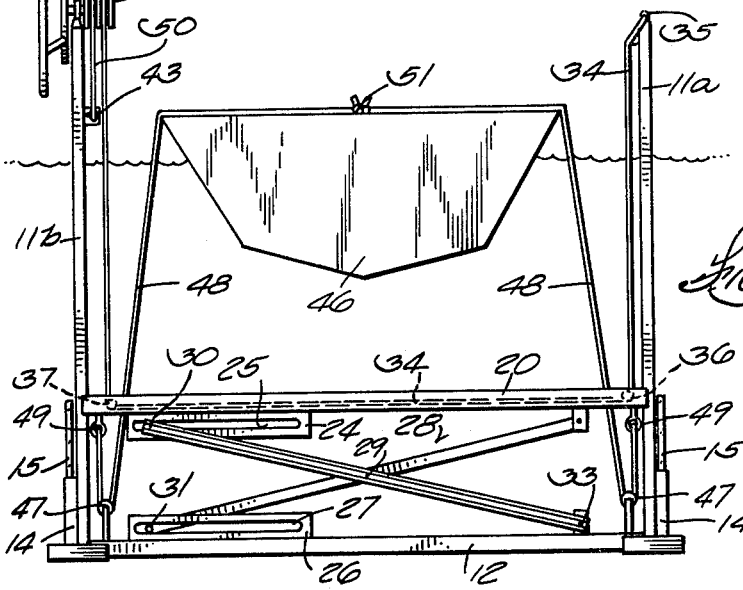
Fig. 4

BOAT HOISTS

BACKGROUND OF THE INVENTION

Boat hoists have heretofore been provided for use in inland lakes or the like to elevate a boat so that it is supported above the water when not in use. Many of these hoists move the boat in an arc by the swinging of parallelogram frames or the like. Other hoists, such as that shown in U.S. Pat. No. 3,697,048, have been devised wherein there is a straight up and down movement of the boat to lift it out of the water between uses. However, this latter type of hoist has no provision for smooth operation or for uniform movement of the lifting platforms or beams during lifting thereof. Nor has there been any simple and inexpensive way provided for using the same lifting mechanism to free the feet of the frame from the lake bottom at the end of a season.

SUMMARY OF THE INVENTION

The boat hoist has a frame provided with longitudinally spaced pairs of uprights, and there is a horizontal lift beam movably supported by each of said pairs. There is a scissors connection between each lift beam and the associated base beam arranged so that there is sliding action between ends of the bars of the scissors assembly and the beams. Mechanism actuated by a single hand wheel controls the raising and lowering of the two lift beams simultaneously, the scissors assembly maintaining its connection with the lift beams and providing for a smooth operation and for uniform movement of the lifting beams during operation thereof. The invention may also include means operated by use of the same lifting mechanism for freeing the feet of the frame from the lake bottom at the end of a season.

A general object of the invention is to provide a boat hoist which is relatively light in weight, simple and inexpensive in construction, which may be operated by one man through manipulation of a single hand wheel, and which moves the boat smoothly in a straight up and down direction.

A further object is to provide a construction where the lift mechanism may also be employed to free the feet of the main frame from the lake bottom at the end of a season.

With the above and other objects in view, the invention consists of the boat hoist, and all of its parts and combinations, as set forth in the claims, and all equivalents thereof.

BRIEF DESCRIPTION OF THE DRAWINGS

In the accompanying drawings, in which the same reference characters designate the same parts in all of the views:

FIG. 1 is a perspective view of the hoist;

FIG. 2 is a fragmentary view showing the hand wheel and winch mechanism;

FIG. 3 is a diagrammatic view of the cable reeving; and

FIG. 4 is a front end view showing how the lift mechanism may be employed to free the feet of the frame from the lake bottom at the end of a season.

DETAILED DESCRIPTION OF THE INVENTION

Referring more particularly to the drawings, the numeral 10 designates a main frame. It includes spaced pairs of upright members, 11*a* and 11*b* being one pair and 11*c* and 11*d* being another pair. They are preferably formed of rectangular metal tubing. The upright members at each end are connected by a base beam 12, and on each side are angle braces 13 arranged in X-shape and suitably connected at their ends to the uprights as shown in FIG. 1. Connected to the lower end of each upright and extending parallel thereto for a short distance is a tubular metal guide 14 for slideably receiving an upright leg extension 15 from a foot 16. Each leg extension has spaced adjustment holes 17, and there is a hole 18 in each guide. A pin 19 inserted through the hole 18 and through a selected hole 17 of a leg extension can hold the parts in a desired position of adjustment, thereby making it possible to set the feet 16 a selected distance below the main frame.

A lifting beam 20 at each end, preferably of rectangular metal tubing, has U-shaped extensions at its ends, as at 21, to straddle the sides of the uprights and thereby guide the lifting beam 20 in up and down movement. The lifting beam 20 may have a wooden plank 22 connected to its upper side, and one of the beams may have saddle members 23 supported thereon and positioned to receive the V-bottom at the bow of the boat.

Attached to the lower side of each lifting beam is a slotted guide 24 having a slot 25 therein which extends parallel to the beam. A similar guide 26 is mounted on the upper side of each base beam 12 below the guide 24. Each of these members 26 has a slot 27. Each scissors assembly 28 includes two metal bars, preferably U-shaped in cross-section, pivoted together as at 29. One end of one of the scissors bars has a travelling member 30, such as a wheel or pin, which rides in the slot 25, and the corresponding end of the other bar has a travelling member 31, such as a wheel or pin, which rides in the slot 27 of the guide 26. The other ends of the scissors bars are suitably fixedly pivoted as at 32 and 33 to the lifting beam 20 and to the base beam 12 as shown in FIG. 2. As a result of this arrangement, when the beam 20 is moved upwardly from the position of FIG. 1, the travelling members 30 and 31 of the scissors assemblies will ride in the slots 25 and 27 and the scissors assembly will assume a more upright disposition and will assure a smooth movement of the lifting beam and will assure that both the left and right-hand ends, referring to FIG. 1, move an equal amount.

A lifting cable 34 has one end deadended as at 35 at the upper end of the right-hand upright 11*a* of FIG. 1. This cable extends downwardly in parallelism with the upright portion adjacent thereto (see FIG. 3), and passes beneath a pulley 36 near one end of the lifting beam 20. The cable then passes through the tubular beam and around a pulley 37 at the opposite end. The cable then extends upwardly adjacent the left-hand upright of FIG. 1 and is windable on the drum section 38 of a winch 39 (see FIG. 2), the winch being operated by a hand wheel 40 which is rotatably carried adjacent the upper end of the left-hand upright of FIG. 1.

Referring again to FIG. 3, the lifting beam 20 at the opposite end of the frame also has pulleys therein like the pulleys 36 and 37 heretofore described in connection with FIG. 1. A cable 50 which is deadended at the top of upright 11*d* extends downwardly along the upright 11*d* and then passes beneath the pulley 36 at one end of the lifting beam, through the lifting beam as shown in FIG. 3, and then upwardly along upright 11*c*, and then passes around an auxiliary pulley 41 at one end of a side tubular horizontal member 42. The cable then passes through the tubular member 42 to the bow end of the device, around an auxiliary pulley 43, and then up to winch drum section 44 as shown in FIGS. 2 and 3.

The hand wheel 40 is adapted to rotate a shaft 45, and there is suitable reduction gearing between the shaft 45 and the drums 38 and 44 to cause rotation of the latter with a mechanical advantage, as is well known in the art, there being any suitable ratchet mechanism to enable the winch mechanism to be locked in a desired position, as is also well known in the art.

With the above arrangement, when the hand wheel 40 is rotated in one direction, there will be a simultaneous winding of the cables 34 and 50 on the drums 38 and 44, respectively. This will cause the lifting beams 20 and planks 22 thereon to be lifted smoothly in an upright direction the same amount at each end of the hoist. A boat floating in the water between the uprights will ultimately be engaged by the lifting beams, and by continuing the operation of the hand wheel the boat will be lifted out of the water to the supported in this position until it is again desired to use the boat. To lower the boat back to floating position, the operation is reversed.

An important feature of the present invention is the use of a scissors assembly beneath each of the beams 20. These scissors operate with the lifting beams during movement of the latter and insure that the beams move uniformly throughout their length, and also insure a smooth operation.

At the end of a season there has heretofore been a considerable problem connected with the dislodging of the feet of a relatively heavy frame from the lake bottom. This problem is the result of settling which takes place during the period of use, such that the feet sometimes become imbedded a considerable distance in the lake bottom. The present invention provides a simple way of dislodging the feet.

Referring again to FIG. 1, and also referring to FIG. 4, each of the base beams has pulleys 47 attached thereto adjacent opposite ends. Cables 48 which are deadended to eyes 49 or the like on the lower side of each lifting beam 20 pass downwardly around the pulleys 47. When it is desired to free the feet from the lake bottom, the cable 48 on the two sides are connected in the manner shown in FIG. 4, are passed over the top of a floating boat 46, and are then connected together as at 51 (FIG. 4). This is, of course, done at both ends of the boat. Then, upon manipulation of the hand wheel in a platform raising direction, a pull is exerted in an upward direction on the base beams 12, the load being transmitted to the floating boat. As movement continues, the base beams will ultimately be pulled toward the floating boat and the feet thus dislodged from the lake bottom.

Various changes and modifications may be made without departing from the spirit of the invention, and all of such changes are contemplated as may come within the scope of the claims.

What I claim is:

1. In a boat hoist having a frame provided with longitudinally spaced pairs of uprights and having a horizontal lift beam movably supported adjacent each pair of uprights, the improvement comprising a base beam connecting the lower ends of each pair of uprights and a scissors assembly between each base beam and the corresponding lift beam, each scissors assembly including horizontal guideways secured to corresponding portions of the lift beam and base beam and a travelling member movably engaged with each guideway, and each scissors assembly also including crossed bars, one bar having one end pivoted to the lift beam and its other end connected to the travelling member for the base beam, and the other bar having one end pivoted to the base beam and its other end connected to the travelling member for the lift beam, and means for moving said lift beams up or down to raise or lower a boat supported thereon, in which each lift beam has a pulley at each end and in which the means for moving the lift beams up and down comprises a winch having a winding drum supported near the upper end of one upright of a first pair, a first cable deadended to the upper end of the other upright of said pair and then extending downwardly beneath the pulley at one end of the lift beam for said pair of uprights, along the lift beam, beneath the pulley at the opposite end, and then upwardly to the winch drum; a second cable deadended to the upper end of the upright of the second pair which is on the same side of the frame as the upright of the first pair to which the first cable is deadended, extending downwardly beneath the pulley at one end of the lift beam for said second pair, along the beam and beneath the pulley at the other end of said beam, and upwardly along the other upright of said second pair, there being an auxiliary pulley spaced upwardly on said last mentioned upright, and a corresponding auxiliary pulley on the upright having the winch, and said second cable having a length passing from one of said auxiliary pulleys to the other and then up to said winch drum whereby when the winch is operated both cables are acted on to move both lift beams simultaneously.

2. A boat hoist as claimed in Claim 1 in which there is a tubular upper beam connecting the upright which has the winch with the corresponding upright of the other pair, in which the auxiliary pulleys are at ends of said upper beam, and in which the length of cable passing from one auxiliary pulley to the other passes through said upper beam.

3. In a boat hoist having a frame provided with longitudinally spaced first and second pairs of uprights and having a horizontal lift beam movably supported adjacent each pair, the improvement comprising a base beam connecting the lower ends of each pair of uprights, each lift beam having a pulley at each end, an upright of the first pair having a winch drum supported near its upper end on a first side of the frame, a first cable deadended to the upper end of the opposite upright of said first pair and then extending downwardly beneath the pulley at one end of the lift beam of said first pair of uprights, along the lift beam and beneath the pulley at the opposite end, and then upwardly to the winch drum; a second cable deadended to the upper end of the other upright on a second side of the frame, extending downwardly beneath the pulley at one end of the lift beam for the second pair of uprights, along the beam and beneath the pulley at the other end of said beam, upwardly along the adjacent upright on said first side of the frame, there being an auxiliary pulley spaced upwardly on said last upright and a corresponding auxiliary pulley on the upright having the winch, and said second cable having a length passing from one of said auxiliary pulleys to the other and then up to said winch drum whereby when the winch is operated both cables will be acted on to move both lift beams simultaneously.

* * * * *